United States Patent [19]

Winter et al.

[11] Patent Number: 4,766,813

[45] Date of Patent: Aug. 30, 1988

[54] METAL SHAPED CHARGE LINER WITH ISOTROPIC COATING

[75] Inventors: Joseph Winter, New Haven; Derek E. Tyler, Cheshire, both of Conn.

[73] Assignee: Olin Corporation, New Haven, Conn.

[21] Appl. No.: 947,446

[22] Filed: Dec. 29, 1986

[51] Int. Cl.[4] ..... F42B 1/02

[52] U.S. Cl. ..... 102/307; 102/309; 102/476; 419/38

[58] Field of Search ..... 102/306–310, 102/476; 419/38

[56] References Cited

U.S. PATENT DOCUMENTS

| | | | |
|---|---|---|---|
| 2,797,892 | 7/1957 | Ryan . | |
| 2,870,709 | 1/1959 | Boelter, Jr. | 102/307 |
| 3,025,794 | 3/1962 | Lebourg et al. | 102/307 |
| 3,077,834 | 2/1963 | Caldwell | 102/307 |
| 3,117,518 | 1/1964 | Porter et al. | 102/307 |
| 3,169,479 | 2/1965 | Bryan | 102/306 |
| 3,224,368 | 12/1965 | House | 102/310 |
| 3,237,559 | 3/1966 | Auberlinder | 102/307 |
| 3,439,613 | 4/1969 | Thomanek | 102/493 |
| 3,443,518 | 5/1969 | Cross | 102/306 |
| 3,797,391 | 3/1974 | Cammarata et al. | 102/4 |
| 3,838,643 | 10/1974 | Austin et al. | 102/307 |
| 3,878,085 | 4/1975 | Corbani | 204/298 |
| 4,041,866 | 8/1977 | Thevenin et al. | 102/307 |
| 4,327,643 | 5/1982 | Grosse-Benne et al. | 102/307 |
| 4,359,943 | 11/1982 | Majerus | 102/309 |
| 4,387,773 | 6/1983 | McPhee | 102/476 |
| 4,463,678 | 8/1984 | Weimer et al. | 102/307 |
| 4,498,367 | 2/1985 | Skolnick et al. | 102/310 |
| 4,499,830 | 2/1985 | Majerus et al. | 102/309 X |
| 4,551,287 | 11/1985 | Bethmann | 102/289 X |
| 4,598,643 | 7/1986 | Skrocki | 102/307 |

FOREIGN PATENT DOCUMENTS

| | | | |
|---|---|---|---|
| 2522805 | 9/1983 | France | 102/307 |
| 832685 | 4/1960 | United Kingdom . | |
| 839872 | 6/1960 | United Kingdom | 102/306 |

*Primary Examiner*—Peter A. Nelson

*Attorney, Agent, or Firm*—Gregory S. Rosenblatt; Paul Weinstein

[57] ABSTRACT

The present invention relates to a composite liner for a shaped charge device. The liner comprises a wrought metal or metal alloy substrate having a desired shape and configuration and a coating deposited on a surface of the wrought substrate. The coating comprises a substantially uniform, substantially homogeneous isotropic material having a relatively fine grain structure and a relatively smooth surface which facilitates forming a metal jet having improved performance and penetration.

22 Claims, 1 Drawing Sheet

METAL SHAPED CHARGE LINER WITH ISOTROPIC COATING

The present invention relates to a shaped charge device having a composite liner for providing improved jet performance and penetration. The application relates to U.S. patent application Ser. No. 930,626 entitled "SHAPED CHARGED LINER" by Shapiro et al. which is assigned to a common assignee.

Shaped charge devices are widely used as a means for destroying armored vehicles and for putting oil wells into production. Shaped charges operate on the principle of the directional effect produced by an explosive charge having a primed side and an open cavity on a free side opposed to the primed side. The function of a shaped charge is to form a high velocity metal jet which can penetrate a metal wall such as the armor on a vehicle. A shaped charge comprises a metal casing and an explosive charge within said casing. While the explosive charge can have any desired shape, it generally has a cylindrical shape with one end hollowed out to form a cavity often having a conical shape. The cavity is lined with a relatively thin metal liner from which the jet that penetrates the metal wall is formed.

The jet formation process is started by initiating the explosive with a detonator-booster unit. The detonation front travels in an expanding spherical shock wave. As the shock wave passes through the metal liner, the liner collapses. This causes the formation of a penetration jet having a small mass of metal moving at an extremely high velocity and a relatively large mass of metal known as a slug following the jet at a much lower velocity. About 80% of the liner material goes into the slug, while the remainder forms the high velocity jet.

The tip of the jet has a velocity which is typically about 9.5 km/sec while the tail of the jet has a velocity of about 2 km/sec. The jet's velocity gradient causes it to stretch and ultimately to segment. Penetration of the metal wall or armor occurs at extremely high pressures because of the jet's high velocity. Due to the nature of the penetration mechanism, the jet is typically used up as it penetrates the target.

Enhanced penetration is the goal of shaped charge liner manufacturers. There are several factors which affect the degree of penetration that can be achieved. The first is the particular shape of the liner which must be very carefully designed to insure proper functioning of the device. Another factor which is critical to efficient operation is the metallurgical condition of the liner. Specifically, surfaces must be extremely smooth and the liner surface which upon firing creates the penetrating jet must be of fine grain. Still another factor is the ductility of the material forming the liner. It has been found that the amount of penetration achieved is equal to the length of the jet times a density function. Since target penetration is proportional to the length of the jet, it is desirable to get as much stretching of the jet as possible. This is done by using very ductile materials for the liner.

Pure ductile materials, specifically materials with cubic face centered crystalline structure, such as copper, nickel and aluminum, in wrought form have been used for shaped charge liners because of their tendency to form good jets. U.S. Pat. Nos. 2,797,892 to Ryan, 4,387,773 to McPhee, 4,463,678 to Weimer et al., and 4,598,643 to Skrocki illustrate some of these materials. The performance of these materials has generally been less than desired because they exhibit discontinuities such as random grain size, roughened surfaces and poor crystallographic or mechanical texture as a result of previous forming operations - all of which adversely affect jet formation and performance. High purity copper alloys for example tend to recrystallize at very low temperatures and as a function of temperature excursion and time can grow significantly large grains that severely inhibit penetration kinetics. Discontinuities of any kind are undesirable because they interfere with the desired uniform energy flow pattern caused by the explosive and therefore, diminish jet performance.

It has been suggested that a purely electroformed liner such as that illustrated in U.S. Pat. No. 2,870,709 to Boelter, Jr. would overcome the problems associated with the aforementioned wrought materials. One of the problems with pure electroformed liners is that as one builds up liner thickness during the electroforming process, dendritic growths tend to appear on the liner surfaces. These dendritic growths are deleterious because they roughen the liner surface and interfere with the desired energy flow pattern. Other concerns involve the particular plating solution used to form the liner. In the Boelter, Jr. patent, the liner is formed by immersing a mandrel in an electrolyte bath, impinging a spray on the mandrel to form a cone, and removing the cone from the mandrel. A copper cyanide bath solution is utilized by Boelter, Jr. as the electrolyte bath. The use of cyanide plating solutions raises certain environmental and toxilogical concerns. The solutions to these concerns generally render the process economically impractical.

Another approach for increasing the effectiveness of shaped charge liners and the penetration jet has been to replace monolithic metal liners with composite liners. These composite liners frequently have a copper or copper alloy layer lined with a layer of zinc or aluminum, although other metals such as tantalum, lead, and silver have been used in lieu of the zinc and aluminum. U.S. Pat. Nos. 3,025,794 to Lebourg et al., 3,117,518 to Porter et al., 3,169,479 to Bryan, 3,224,368 to House, 3,237,559 to Auberlinder, 3,439,613 to Thomanek, 3,797,391 to Cammarata et al., 4,041,866 to Thevenin et al., 4,327,642 to Grosse-Benne et al., 4,359,943 to Majerus, and 4,498,367 to Skolnick et al. as well as U.K. patent No. 832,685 illustrate typical composite shape charge liners. U.S. Pat. No. 3,838,643 to Austin et al. illustrates a variation of a composite liner in which a very thin coating of copper, nickel or chromium is applied to a steel liner. The deficiency of the Austin et al. approach is the failure to recognize that not all coating techniques produce structures useful in shaped charge liners. For example, mere immersion of a steel liner in a coating solution may not provide the surface smoothness and/or grain size needed to form an effective jet.

Another attempt to improve liner performance has included forming the liner from a plurality of metal spheres. U.S. Pat. No. 3,077,834 to Caldwell illustrates such a liner. The spheres are formed from copper, bronze or some other solid metal and have a diameter in the range of from about 3 microns to about 50 microns. They are coated with a metal having a lower melting point such as tin to enable the spheres to be welded together. In an alternative Caldwell embodiment, the liner comprises a thin solid metallic layer and an adherent layer formed from a plurality of metal spheres.

Despite the numerous shaped charge liners described in the aforementioned patent literature, there is still a need for more effective shaped charge devices having improved liner performance. In particular, there is a need for a liner construction which yields improved jet formation and performance.

Accordingly, it is an object of the present invention to provide an improved shaped charge device.

It is a further object of the present invention to provide a device as above having a liner capable of providing improved jet formation and performance.

It is still a further object of the present invention to provide a shaped charge device as above having a liner formed by a composite material having a relatively smooth, fine grained inner layer.

These and other objects and advantages will become more apparent from the following description and drawings in which like reference numerals depict like elements.

The present invention relates to a composite liner construction for a shaped charge device. The composite liner has an appropriately shaped outer layer or substrate formed from a wrought material and an inner layer formed from a deposited, substantially uniform, substantially homogeneous, isotropic material having a relatively fine grain structure. The inner layer is further characterized by a relatively smooth surface. Since it is the inner layer which ultimately becomes the metal jet, the composite liner of the present invention yields an improved jet that is longer, thinner, more uniform, and more reproducible than jets formed from other materials. Further, the composite shaped charge liner of the present invention yields improved jet penetration.

In accordance with the present invention, the outer layer of the composite liner is formed from a ductile metal or metal alloy selected from the group consisting of copper, nickel, zinc, aluminum, tantalum, tungsten, uranium, antimony, magnesium, and/or alloys and/or mixtures thereof. This outer layer serves to provide dimensional control and permits optimization of the liner configurational shape. The inner layer is preferably a relatively thin, fine grained electrodeposited coating on a surface of the outer layer. Alternatively, the inner layer may be a coating formed using either a sputter deposition or a chemical vapor deposition technique.

As previously discussed, jet formation and jet performance in a shaped charge device are related to the structure of the liner. Factors which influence jet formation and performance include the surface characteristics and grain size of the material from which the jet is formed. Thus, it becomes desirable to utilize a material having a relatively fine grain structure, i.e. sub-micron size grains, and a relatively smooth surface structure as a shaped charge liner material.

Figure 1:
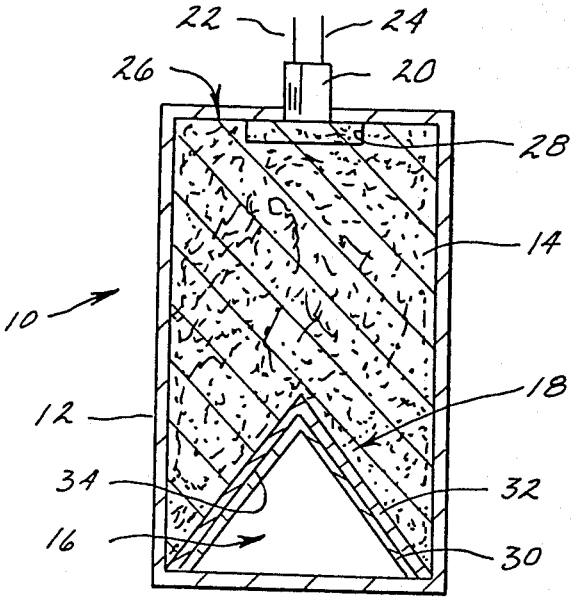
FIG. 1 illustrates a cross section of a shaped charge device in accordance with the present invention.

Referring now to FIG. 1, a shaped explosive device 10 in accordance with the present invention is illustrated. The device 10 has a hollow, substantially cylindrical container or casing 12 in which an explosive charge 14 is located. The casing 12 may be constructed of any material of sufficient strength to act as a retainer for the explosive material. For example, the casing may be fabricated from a heavy or dense material such as lead or steel. The casing may be designed to minimize the effects of undirected pressure waves while increasing the penetration power of the device for a given amount of explosive charge. While the casing 12 has been illustrated as being substantially cylindrical in shape, it may in fact have any shape suitable to achieve the desired jet formation and penetration. For example, the casing could be substantially conical if desired.

The charge 14 is formed with a hollowed out end or cavity 16 which has a closely fitting liner 18. The charge 14 may be any conventional explosive charge known in the art. Any suitable means known in the art may be used to detonate the explosive charge 14. For example, a lead charge 28 may be embedded within a portion of the charge opposed to the cavity 16. The lead charge may be joined to a suitable detonator 20 such as one having a plurality of leads 22 and 24 to be connected to an electrical power source not shown. The detonator 20 and lead charge 28 may comprise any conventional detonator and lead charge known in the art.

The cavity 16 in the charge is generally shaped to enhance device performance. While there are many different possible shapes for the cavity, it typically has either a substantially conical shape, such as that shown in FIG. 1, or a bell or fluted shape not shown. The liner 18 in a shaped charge device forms the penetration jet as well as the slug that follows the jet. The liner 18 is thus designed to be closely fitting and have substantially the same shape as the cavity 16. Consequently, in the device shown in FIG. 1, the liner 18 has a substantially conical shape. Here too, the liner may have other shapes, such as a bell shape or fluted shape, depending upon the type of jet to be created.

As previously discussed, the function of a shaped charge device is to form a high velocity metal jet which is capable of penetrating a metal wall such as the armor on a tank, airplane or ship. The jet formation process is started by detonating the detonator 20 to ignite the lead charge 28 which in turn ignites the explosive charge 14. The detonation of the charge proceeds from an end 26 adjacent the detonator 20 to the cavity 16. The cavity 16 is generally considered to be located at the forward end of the device. The detonation wave formed by the detonation of the charge 14 is directed towards the forward end by the walls of the casing 12. As the detonation or shock wave impinges upon the liner 18, it collapses and forms a penetration jet, usually having a small mass of metal moving at an extremely high velocity, and a larger mass of metal or slug moving at a lower velocity.

The amount of penetration achieved is related to the length of the jet which in turn is a function of the ductility of the metal forming the liner 18. It has been found that the effectiveness of the jet is also related to the absence of discontinuities in the portion of the liner from which the metal jet is formed. Discontinuities to be avoided include random and/or large grain sizes, and surface roughness. Thus, it is desirable to form at least the portion of the liner from which the jet is created from a substantially uniform, substantially homogeneous, isotropic material having a relatively fine grain structure, i.e. particles having substantially uniform sub-micron grain sizes. Most conventional liner materials while being ductile tend not to have the desired grain structure. Generally, liner materials have an average grain size in the range of from about 10 to about 20 microns.

In accordance with the present invention, the liner 18 is a composite material having a wrought substrate 32 and a relatively thin layer 30 formed from a substantially uniform, substantially homogeneous, isotropic material having relatively small particles deposited on a surface of the wrought substrate. The wrought substrate 32 preferably forms the outer layer of the liner 18 and is positioned adjacent the explosive charge 14. The use of a wrought structure as a substrate adds dimensional control to the liner. It also permits the liner 18 to be given an optimized configurational shape.

The substrate 32 may be formed from any suitable ductile metal or metal alloy. For example, the substrate 32 may be formed from a metal or metal alloy selected from the group consisting of copper, nickel, zinc, aluminum, tantalum, tungsten, uranium, antimony, magnesium, and/or alloys and/or mixtures thereof. In a preferred construction, the substrate 32 is formed from copper or a copper alloy. A particularly useful copper alloy consists essentially of from about 2.0% to about 6.0% aluminum, from about 1.0% to about 4.0% silicon, from about 0.1% to about 5.0% of at least one transitional element selected from the group consisting of iron, nickel, cobalt, and zirconium and the balance copper. This copper base alloy may contain impurities typical of those in copper base alloy systems of this type.

The wrought material forming the substrate 32 may be fabricated into a desired shape or configuration using any suitable fabrication technique known in the art. For example, the wrought material in sheet or strip form may be fabricated into a substrate having a desired shape using a die stamping process. Thus, a flat strip or sheet of the wrought material may be run through a set of dies not shown which progressively form the desired shape.

The substrate 32 may have any desired thickness. Wall thickness for the substrate 32 is a function of the size of the shaped charge. For most applications, a wall thickness in the range of from about 0.050" to about 0.125" should be sufficient. While the substrate 32 has been illustrated in FIG. 1 as having a constant thickness, it may have a variable thickness if so desired.

The inner layer 30 of the liner 18 as previously discussed is formed from a substantially uniform, substantially homogeneous, isotropic material having a relatively fine grain structure, i.e. particles having a substantially uniform sub-micron grain size in the range of from about 1 micron to about 5 microns. The layer 30 preferably comprises a relatively thin coating having a thickness that is less than about 5% of the total thickness of the liner 18, preferably in the range of from about 10 microns to about 100 microns. The coating is applied to a surface 34 of the substrate 32 not in contact with the explosive charge 14. The coating 30 may be formed using any suitable electrodeposition, sputtering deposition, or chemical vapor deposition technique known in the art.

Figure 2:
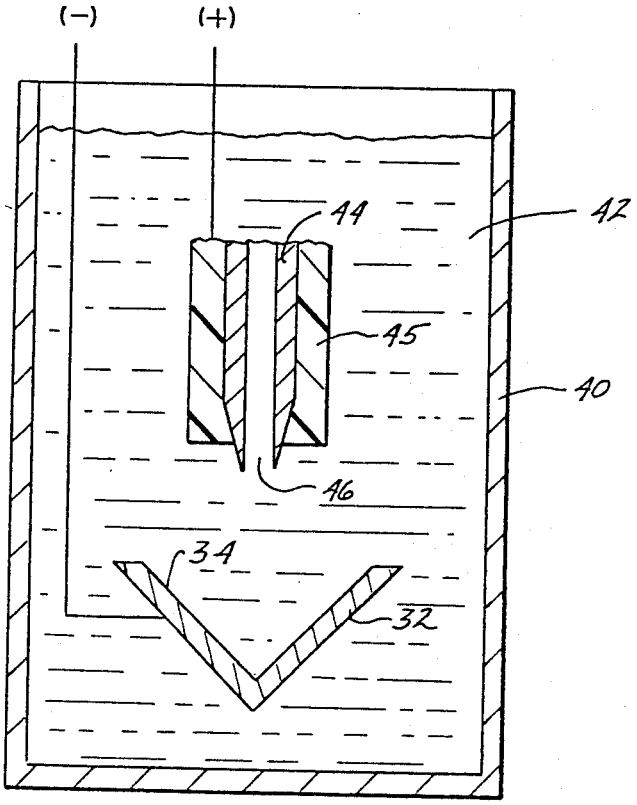
FIG. 2 illustrates an apparatus for coating a surface of the wrought portion of the present shaped charge liner.

Referring now to FIG. 2, a preferred approach for forming the coating 30 is illustrated. The approach comprises placing the wrought substrate 32 in an electrolytic cell 40 containing a suitable electrolyte 42. The substrate 32 is electrically connected to the negative terminal of a power supply not shown and thereby serves as a cathode. An anode structure 44 having an opening 46 through which electrolyte can be sprayed onto the surface 34 to be coated is placed in close proximity to the substrate 32. To prevent plating on surfaces other than the surface 32, the anode structure may be shielded with an appropriate shielding material 45 and the other surfaces of the substrate 32 may be coated with a stop coating material such as wax. Of course, the anode structure 44 is electrically connected to the positive terminal of the power supply. The cell 40 may also contain suitable means not shown for rotating the substrate 32 during electrodeposition. It is desirable to rotate the substrate 32 during plating to facilitate the formation of a substantially uniform coating.

The electrolyte 42 preferably comprises a copper sulfate—sulfuric acid bath maintained at a temperature in the range of from about room temperature to about 65° C. If needed, the cell 40 may be provided with suitable means not shown such as a heating loop for maintaining the electrolyte 42 at an elevated temperature. When used at room temperature, the electrolyte bath 42 may contain a concentration of copper in the range of from about 5 grams per liter, hereinafter g/l, to about 60 g/l, preferably from about 10 g/l to about 40 g/l, and a sulfuric acid concentration in the range of from about 10 g/l to about 100 g/l. To plate a relatively smooth copper layer onto the surface 34, a current having a current density in the range of from about 5 $mA/cm^2$ to about 40 $mA/cm^2$ is applied to the electrodes for a time period in the range of from about 5 seconds to about 120 seconds. Of course, the foregoing concentrations, current densities, and deposition times are dependent upon the temperature of the electrolyte and for temperatures above room temperature may have to be varied.

While it is generally preferred to form a coating having a smooth surface, coatings having roughened surfaces may also be formed using the apparatus of FIG. 2. Such coatings may be appropriate where it is necessary to add mass to the jet forming material. These coatings may be formed using the aforementioned solution at room temperature by applying a current density in the range of from about 55 $mA/cm^2$ to about 350 $mA/cm^2$ for a time period in the range of from about 2 seconds to about 120 seconds.

While it is preferred to form the coating 30 using an electrodeposition technique because of the ability to form relatively smooth surfaces and very uniform particle sizes, it is possible to form the coating 30 using alternative techniques such as sputter deposition and chemical vapor deposition. Any suitable sputter deposition technique such as one similar to that shown in U.S. Pat. No. 3,878,085 to Corbani or any suitable chemical vapor deposition treatment known in the art may be used to form the coating 30. Sputter deposition is a particularly useful approach if the coating is to be formed from a high purity metal such as copper and/or a high density material such as a refractory metal.

While the deposition techniques discussed above are capable of yielding a deposited layer having a relatively smooth surface, modification of the deposited layer surface using techniques that do not affect the grain size of the layer may be used if necessary. These techniques may include compacting, burnishing and the like.

As previously discussed, the shaped charge liner of the present invention provides many significant benefits. The provision of a wrought base or substrate structure is desirable because it provides dimensional control and permits optimization of the configurational shape of the liner. The deposited layer forming the inner surface of the liner is preferably a substantially uniform, substantially homogeneous isotropic material having a relatively fine grain structure. Thus, it is believed that the jet which is formed from this material will have improved performance and penetration. The jet formed from the liner of the present invention should be longer, thinner, more uniform and more reproducible.

While the present invention is discussed in terms of forming a substantially constant thickness coating on the substrate, it is also possible to form a deposited layer having a variable thickness. If desired, the deposited layer could have a variable thickness ranging up to about 20% of the substrate thickness.

The U.S. patents and foreign patent publication set forth in the specification are intended to be incorporated by reference herein.

It is apparent that there has been provided in accordance with this invention a shaped charge liner which fully satisfies the objects, means, and advantages set forth hereinbefore. While the invention has been described in combination with specific embodiments thereof, it is evident that many alternatives, modifications, and variations will be apparent to those skilled in the art in light of the foregoing description. Accordingly, it is intended to embrace all such alternatives, modifications, and variations as fall within the spirit and broad scope of the appended claims.

What is claimed:

1. A liner having a desired shape and a desired thickness for use in a shaped charge device, said liner comprising:

a first layer formed from a wrought metal or metal alloy; and a coating deposited on a surface of said first layer, said deposited coating comprising a substantially uniform, substantially homogeneous isotropic material having a relatively fine grain structure.

2. The liner of claim 1 wherein said deposited coating comprises an electrodeposited coating.

3. The liner of claim 2 wherein said deposited coating comprises a sputter coating.

4. The liner of claim 3 wherein said deposited coating comprises a chemical vapor desired coating.

5. The liner of claim 4 wherein said deposited coating comprises a layer of electrodeposited copper having a thickness less than about 5% of said liner thickness.

6. The liner of claim 5 further comprising said thickness of said electrodeposited copper layer being in the range of from about 10 microns to about 100 microns.

7. The liner of claim 6 further comprising said deposited coating having a relatively smooth external surface and being formed by particles of substantially uniform sub-micron grain size for providing improved formation and performance of a metal jet formed from said coating material.

8. The liner of claim 7 further comprising said metal or metal alloy forming said first layer being selected from the group consisting of copper, nickel, zinc, aluminum, tantalum, tungsten, uranium, antimony, magnesium, and/or alloys and/or mixtures thereof.

9. The liner of claim 8 further comprising said first layer providing dimensional control and permitting configurational shape optimization, said first layer having a thickness in the range of from about 0.050" to about 0.125".

10. A shaped charge device comprising:

a casing;

a shaped explosive charge within said casing, said charge having a cavity formed in a first end; a liner having a desired shape lining said cavity and contacting said charge;

said liner being formed from a composite material comprising a wrought metal or metal alloy substrate having a first surface contacting said charge and a relatively thin coating deposited onto a second surface of said substrate opposed to said first surface; and said deposited coating comprising a substantially uniform, substantially homogenous isotropic material having a relatively fine grain structure.

11. The device of claim 10 further comprising:

said substrate being formed from a metal or metal alloy selected from the group consisting of copper, nickel, zinc, aluminum, tantalum, tungsten, uranium, antimony, magnesium, and/or alloys and/or mixtures thereof; and said deposited coating comprising a layer of electrodeposited copper having a relatively smooth surface not in contact with said substrate second surface and a submicron grain size for improving the performance and the penetration of a metal jet formed from said coating.

12. The device of claim 11 further comprising: said substrate having a thickness in the range of from about 0.050" to about 0.125"; and said deposited coating having a thickness in the range of from about 10 microns to about 100 microns.

13. The device of claim 12 further comprising said coating being a sputter deposited coating.

14. The device of claim 13 further comprising said coating being a chemical vapor deposited coating.

15. The device of claim 14 further comprising: means for detonating said explosive charge.

16. A process for forming a composite shaped charge liner, said process comprising:

forming a substrate having a desired shape and thickness from a wrought metal or metal alloy;

immersing said substrate in an electrolytic bath; and electrolytically forming a coating comprising a substantially uniform, substantially homogeneous isotropic material having a relatively fine grain structure on a surface of said substrate.

17. The process of claim 16 further comprising:

rotating said substrate during said coating forming step so as to form a coating having a substantially uniform thickness.

18. The process of claim 16 of which the grain size of said electrolytically formed coating is less than about 1 micron.

19. The device of claim 10 further comprising said coating being electrolytically deposited coating.

20. The liner of claim 1 wherein said first layer is formed from a wrought metal or metal alloy with a melting temperatures of at least 400° C.

21. The device of claim 11 further comprising said substrate being formed from a metal or metal alloy with a melting temperature of at least 400° C.

22. The process of claim 16 in which the grain size of said electrolytically formed coating is in the range from about 1 micron to about 5 microns.

* * * * *

UNITED STATES PATENT AND TRADEMARK OFFICE

CERTIFICATE OF CORRECTION

PATENT NO. : 4,766,813

DATED : August 30, 1988

INVENTOR(S) : Joseph Winter et al

It is certified that error appears in the above—identified patent and that said Letters Patent is hereby corrected as shown below:

Column 7, line 39, please delete "desired" and insert ---deposited--- in its place.

Column 8, line 12, please delete "homogenous" and insert ---homogeneous--- in its place.

Column 8, line 57, please delete "temperatures" and insert ---temperature--- in its place.

Signed and Sealed this

Fourteenth Day of January, 1992

*Attest:*

HARRY F. MANBECK, JR.

*Attesting Officer*

*Commissioner of Patents and Trademarks*